United States Patent [19]

Ohmatsu

[11] 4,332,885

[45] Jun. 1, 1982

[54] PHOTOGRAPHIC SENSITIVE MATERIALS FOR COLOR DIFFUSION TRANSFER PROCESS

[75] Inventor: Hideki Ohmatsu, Minami-ashigara, Japan

[73] Assignee: Fuji Photo Film Co., Ltd., Minami-ashigara, Japan

[21] Appl. No.: 251,801

[22] Filed: Apr. 7, 1981

[30] Foreign Application Priority Data

Apr. 7, 1980 [JP] Japan ..... 55-45413

[51] Int. Cl.[3] ..... G03C 1/76

[52] U.S. Cl. ..... 430/506; 430/217; 430/379; 430/509

[58] Field of Search ..... 430/506, 217, 378, 379, 430/509

[56] References Cited

U.S. PATENT DOCUMENTS 3,779,764 12/1973 Moll et al. ..... 430/379
3,849,138 11/1974 Wyckoff ..... 430/506
3,923,513 12/1975 Evans ..... 430/378
4,035,185 7/1977 Evans et al. ..... 430/230
4,082,553 4/1978 Groet ..... 430/506

FOREIGN PATENT DOCUMENTS 484294 6/1952 Canada ..... 430/379

*Primary Examiner*—J. Travis Brown
*Attorney, Agent, or Firm*—Sughrue, Mion, Zinn, Macpeak and Seas

[57] ABSTRACT

Photographic sensitive materials for a color-diffusion transfer process which are particularly useful in a wide variety of temperature and climate conditions are disclosed. The materials are comprised of a red-sensitive emulsion layer; a green-sensitive emulsion layer; and a blue-sensitive emulsion layer on a support wherein at least one of the layers is comprised of a plurality of additional layers. Two or more of the additional layers are direct reversal photographic emulsion layers of higher and lower sensitivity which are not previously fogged. The emulsion layer having lower sensitivity has a gradation of 1.8 or more resulting in a hard tone.

4 Claims, No Drawings

PHOTOGRAPHIC SENSITIVE MATERIALS FOR COLOR DIFFUSION TRANSFER PROCESS

FIELD OF THE INVENTION

The present invention relates to photographic sensitive materials for a color diffusion transfer process and, particularly, to the above described sensitive materials capable of always obtaining a preferred gradation when processed through a wide temperature range from a low temperature to a high temperature (namely, processing temperature dependence of gradation).

BACKGROUND OF THE INVENTION

In the color diffusion transfer process, photographic materials for a color diffusion transfer process are popularly used for "instant photography", because color prints can be instantly obtained by utilizing dye images imagewise transferred by diffusion (refer to detailed explanations in, for example, *Photographic Science and Engineering,* Vol. 20, No. 4, pages 155–164, July/August 1976).

This kind of sensitive material must be processed in situ just after photographing. Since the photography is carried out without regard to the season, for example, in summer or winter, or the region, for example, in the tropical zone or the frigid zone, the processing temperature varies according to the season or the region. Accordingly, the prior sensitive materials are undesirable because their gradation varies according to the processing temperature causing deterioration of the quality of images. Particularly, the sensitive materials for a color diffusion transfer process which comprise a direct reversal photographic emulsion layer are undesirable due to the creation of a soft or hard tone at a low or high temperature as compared with those using a negative emulsion as described in Japanese Patent Application (OPI) 90534/74 (The term "OPI" as used herein refers to a "published unexamined Japanese patent application," hereinafter the same). Controlling the gradation has been described in U.S. Pat. No. 4,035,185 and *Research Disclosure,* vol. 151, No. 15162, wherein two kinds of direct reversal photographic emulsions having each a different gradation are mixed or emulsions having different sensitivities are mixed. However, even if mixed emulsions are used, the gradation varies according to the processing temperature, and the resulting prints have an unstable image quality. It is therefore desired to develop sensitive materials capable of forming images having a desired gradation which do not vary according to the processing temperature.

SUMMARY OF THE INVENTION

An object of the present invention is to provide photographic sensitive materials for a color diffusion transfer process which satisfy the above described requirements.

The present invention is a photographic sensitive material for a color diffusion transfer process comprising: a red-sensitive emulsion layer; a green-sensitive emulsion layer; and a blue-sensitive emulsion layer on a base. At least one of the red-, green-, or blue-sensitive emulsion layers is composed of a plurality of additional layers wherein (1) at least two of the additional layers are direct reversal photographic emulsion layers having different sensitivities which were not previously fogged and (2) the gradation of the emulsion layer having a lower sensitivity has a hard tone ($\overline{\gamma}=1.8$ or more). Sensitive materials comprised as such have a desired gradation. The processing temperature dependence of materials of the invention is remarkably improved as compared with soft tone emulsions, if direct reversal emulsions having a gradation of 1.8 or more which were not previously fogged are used.

DETAILED DESCRIPTION OF THE INVENTION

The term "gradation ($\overline{\gamma}$)" of the emulsion used means a value measured under a condition that a sensitive material prepared under the same condition as that in the completed sensitive material except that a single layer is applied instead of a plurality of layers having the same color sensitivity (but the silver content in the single layer to be measured is at least equal to the total silver content in the whole of plural layers) is exposed to light for 1/100 seconds and processed at 25° C. (The processing solution used is the same as that used for the completed sensitive material. Further, the thickness of the spread solution is the same. Further, the cover sheet used for neutralizing alkalis in the processing solution is the same as that used for the completed sensitive material. Moreover, in case of stripping type diffusion transfer films, stripping is carried out for a prescribed period of time, generally 30 seconds to 4 minutes). The $\overline{\gamma}$ value can be calculated by dividing the density difference 0.3 between the densities (D) 1.0 and 0.7 in a characteristic curve of the sensitive material comprising a single coating layer having 2.0 of the maximum density (D max) by a difference of logarithmic values of each exposure for these densities ($\Delta$ log E), namely $\overline{\gamma}=(1.0-0.7)/|\Delta \log E\{$.

The emulsion layer having a higher sensitivity in the plural coating layers preferably has a gradation of 1.8 or more. The gradation may be identical to or different from the gradation of the emulsion layer having a lower sensitivity.

The gradations ($\overline{\gamma}$) of the emulsion layers having a higher sensitivity and a lower sensitivity in the plural coating layers are preferably 1.8 to 5.0 and more preferably 1.8 to 4.0.

The difference in sensitivity between two photosensitive emulsion layers in a plural coating of layers is preferably about 0.2 or more (the upper limit is about 0.5) as the unit of log E.

In a preferred layer construction of the sensitive material, the emulsion layer having a comparatively high sensitivity is placed nearer to the side to be exposed to light than the emulsion layer having lower sensitivity. By positioning the layer in this manner, it is possible to reduce softening of the tone obtained by developing at a low temperature, if the silver halide in the emulsion layer (having a relatively low sensitivity) has a particle size lower than that of silver halide in the emulsion layer having a relatively high sensitivity. Further, it has been found that the minimum density (D min) of the transferred images can be reduced if a photographic emulsion comprising silver halide having a small particle size is used. Moreover, it has been found that the use of the sensitive material of the present invention causes diminution of softening of the tone, i.e., diminution of the trailing foot part in the characteristic curve. This softening occurs due to exposing the material for a long time, at a low illuminance.

In the photosensitive photographic emulsions used in the present invention, silver halide is preferably used as a photosensitive substance. The silver halide emulsion is a hydrophilic colloid dispersion of silver chloride, silver bromide, silver chlorobromide, silver iodobromide, silver chloroiodobromide or a mixture thereof. The halogen composition of silver halide is selected for a particular use and processing condition for the sensitive material. It has been found particularly desirable to use silver bromide, silver iodobromide or silver chloroiodobromide having an iodine content of 10% by mole or less and a chloride content of 30% by mole or less.

The direct reversal photographic emulsions which are not previously fogged are known. They are, in short, emulsions which form direct reversal images when they are fogged during development after being imagewisely exposed to light. For example, fogging is carried out by exposing the imagewisely exposed emulsions to light during the development processing or by developing the imagewisely exposed emulsions in a presence of a nucleus forming agent (fogging agent).

As this type of emulsions, internal latent image type emulsions are used. Example of suitable internal latent image type silver halide emulsions include a conversion emulsion prepared by a catastrophic precipitation process. This process comprises producing firstly silver salt particles having a high solubility, such as silver chloride particles. These particles are converted into silver salt particles having a low solubility such as silver bromide or iodobromide particles (U.S. Pat. No. 2,592,250). Another suitable emulsion is a core-shell emulsion prepared by ageing a mixture of a core emulsion of chemically sensitized large particles and an emulsion of fine particles to cover the core particles with a silver halide shell (U.S. Pat. No. 3,206,313 and British Patent No. 1,011,062). Still other suitable emulsion include: a core-shell emulsion prepared by adding a solution of a soluble silver salt and a solution of soluble halide at the same time to a chemically sensitized core emulsion of monodispersion while keeping the silver ion concentration at a fixed value to cover the core particles with a silver halide shell (British Pat. No. 1,027,146 and U.S. Pat. No. 3,761,276); a heterogeneous halogen emulsion wherein the emulsion particles have a laminar construction composed of two or more layers wherein the halogen composition of the first phase is different from that to the second phase (U.S. Pat. No. 3,935,014); and an emulsion prepared by forming silver halide particles in an acid medium containing trivalent metal ions to incorporate different kinds of metal (U.S. Pat. No. 3,447,927). In addition, there are emulsions prepared by processes described in *Photographic Emulsion* written by E. J. Wall, pages 35–36 and 52–53, American Photographic Publishing Co., (1929), U.S. Pat. Nos. 2,497,875, 2,563,785 and 3,511,662 and German Patent Application (OLS) 2,728,108.

The nucleus forming agents for such emulsions include hydrazines described in U.S. Pat. Nos. 2,588,982 and 2,563,785, hydrazides and hydrazones described in U.S. Pat. No. 3,227,552, quaternary salt compounds described in British Pat. No. 1,283,835, Japanese Patent Publication 38164/74 and U.S. Pat. Nos. 3,615,615, 3,719,494, 3,734,738, 4,094,683 and 4,115,122, sensitizing dyes having a nucleating substituent which has a fogging function in the dye molecule described in U.S. Pat. No. 3,718,470 and acylhydrazinophenyl thiourea compounds described in U.S. Pat. Nos. 4,030,925 and 4,031,127. In addition, there are compounds described in, for example, U.S. Pat. No. 4,139,387 and Japanese Pat. application (OPI) Nos. 133126/79 and 74729/79.

The nucleus forming agent is preferably used in an amount sufficient to obtain maximum density when the internal latent image type emulsion is developed with a surface developing solution. In practice it has been found that a suitable amount varies over a wide range because it depends on both the properties of the silver halide emulsions used, the chemical structure of the fogging agent, and developing conditions. The fogging agent is generally added to the developing solution in amounts of about 0.01 g to 5 g, preferably 0.05 g to 1 g, per liter of the developing solution. When adding a nucleus forming agent to the emulsion layer, a practical amount is about 0.1 mg to 5 g per mole of silver in the internal latent image type silver halide emulsion, preferably about 0.5 mg to about 2 g per mole of the silver. When incorporating the nucleus forming agent in a hydrophilic colloid layer adjacent to the emulsion layer, it may be added in a similar amount to that for the internal latent image type emulsion based on the silver content of the emulsion.

The silver halide emulsions used in the present invention may be provided with a spread color sensitivity by addition of spectral sensitizing dyes. As the spectral sensitizing dyes, cyanine dyes and merocyanine dyes are suitably used.

In order to obtain transfer dye images (which may be black), dye image donative compounds are used in combination with the silver halide emulsion layer. The dye image donative compounds may be contained in the silver halide emulsion layer or may be contained in a layer adjacent to the silver halide emulsion layer.

As the dye image donative compounds, dye developing agents can be used, but dye releasing redox compounds (DRR compound) and dye releasing couplers are particularly useful.

Examples of DRR compounds from which a dye is released in an oxidized state by hydrolysis with alkali are described in U.S. Pat. Nos. 4,053,312, 4,055,428, 4,076,529, 4,152,153 and 4,135,929, Japanese patent application (OPI) Nos. 149328/78, 104343/76, 46730/78, 130122/79, 3819/78, 12642/81, 16130/81 and 16131/81. Compounds which release a yellow dye are described in U.S. Pat. No. 4,013,633, Japanese Pat. application (OPI) Nos. 149328/78 and 114930/76, Japanese patent application No. 148237/79, and *Research Disclosure* 17630('78) and 15475('77). Compounds which release a magenta dye are described in U.S. Pat. Nos. 3,954,476, 3,931,144 and 3,932,308, Japanese patent application (OPI) Nos. 23628/78, 106727/77, 65034/79, 161332/79, 4028/80, 36804/80 and 134850/80 Japanese patent application Nos. 149777/79 and 146655/79 and German patent application (OLS) No. 2,847,371. Compounds which release a cyan dye are described in U.S. Pat. Nos. 3,942,987, 3,929,760 and 4,013,635, Japanese patent application (OPI) Nos. 109928/76, 149328/78, 8827/77, 143323/78 and 47823/78 and Japanese patent application No. 146654/79.

Redox compounds which release a dye by ring-closure, etc. of the compound which was not subjected to oxidation are described in U.S. Pat. Nos. 4,139,379 and 3,980,479 and German patent application (OLS) Nos. 2,402,900 and 2,448,811, etc.

Particularly preferred combinations of the silver halide emulsion layer and the dye image donator include a combination of a blue-sensitive silver halide emulsion and a yellow dye releasing redox compound; a combination of a green-sensitive emulsion and a magenta dye releasing redox compound; and a combination of a red-sensitive emulsion and a cyan dye releasing redox compound.

Examples of mordanting layers, neutralizing layers, layers for controlling a neutralizing rate (timing layer) and processing compositions, etc. useful in connection with sensitive materials for the color diffusion transfer process of the present invention are described in Japanese patent application (OPI) No. 149320/78.

Preferred sensitive materials for a color diffusion transfer process of the present invention are monosheet type film units (combination of a photosensitive element, a image receiving element and a processing element) which are unified in a body before, during and after exposure and can be developed in the light. Such film units have been described in the above described *Photographic Science and Engineering* and *Neblette's Handbook of Photography and Reprography Materials, Process and Systems,* Seventh Ed. (1977), 12, etc.

The following Example is given to illustrate this invention in greater detail although this invention is not limited thereto.

EXAMPLE

To a transparent polyethylene terephthalate film support, the following layers were applied in turn to produce Photosensitive Sheet I.

(1) A mordanting layer containing copoly-(styrene-N-vinylbenzyl-N,N,N-trihexylammonium chloride) (3.0 g/m$^2$) and gelatin (3.0 g/m$^2$).

(2) A light reflection layer containing titanium dioxide (20 g/m$^2$) and gelatin (2.0 g/m$^2$).

(3) A light shielding layer containing carbon black (3.0 g/m$^2$) and gelatin (2 g/m$^2$).

(4) A layer containing 0.44 g/m$^2$ of a cyan dye releasing redox compound of formula (I), tricyclohexyl phosphate (0.09 g/m$^2$), 1,5-di-t-pentadecylhydroquinone (0.008 g/m$^2$) and gelatin (0.8 g/m$^2$).

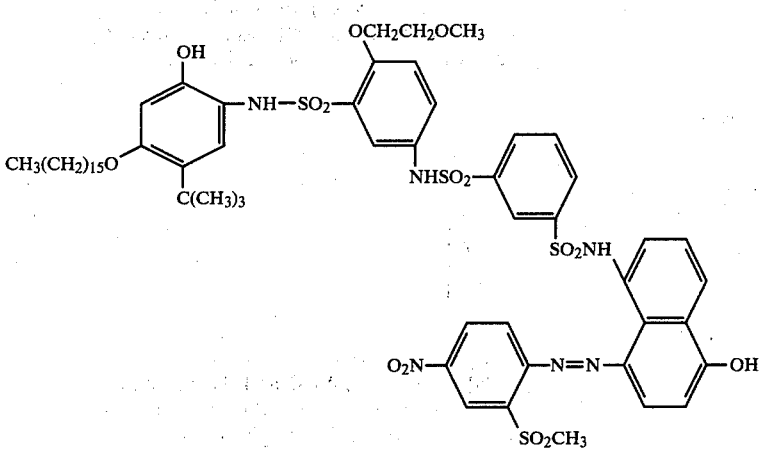

(I)

(5) A red-sensitive emulsion layer containing the Emulsion - 1 (silver content 1.03 g/m$^2$) spectrally sensitized by the following red sensitizing dye, gelatin (1.2 g/m$^2$), the following nucleus forming agent (0.04 mg/m$^2$) and 2-sulfo-5-n-pentadecylhydroquinone sodium salt (0.13 g/m$^2$).

Red sensitizing dye

-continued

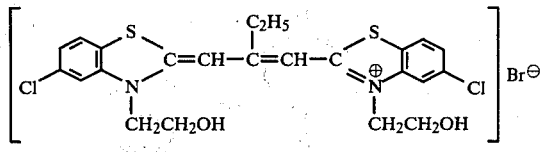

(0.1 mg/m$^2$)

Nucleus forming agent

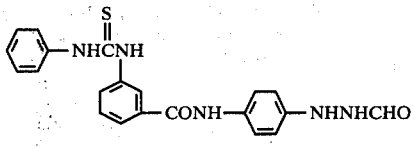

Preparation of Emulsion—1

To 1 liter of an aqueous solution containing 10 g of gelatin, equimolar amounts of an aqueous solution of silver nitrate and an aqueous solution of potassium bromide were added at 50° C. by a control double jet process for 30 minutes to obtain octahedral silver bromide particles having a particle size of 1.2$\mu$. To the resulted core emulsion, 1.0 mg of sodium thiosulfate/mol of silver and 1.7 mg of potassium chloroaurate (III)/mol of silver were added, and the emulsion was chemically aged at 60° C. for 45 minutes. To the resulted chemically aged core emulsion, equimolar amounts of an aqueous solution of silver nitrate and an aqueous solution of potassium bromide were added at 60° C. by a control double jet process for 40 minutes to produce a core-shell type direct reversal photographic emulsion having a particle size of 1.32$\mu$. After formation of the shell, 0.5 mg of sodium thiosulfate/mol of silver and 0.75 mg of potassium chloroaurate (III)/mol of silver were added to carry out chemical sensitization of the surface of the shell.

(6) A layer containing 0.43 g/m$^2$ of a compound of formula (II), trihexylphosphate (0.1 g/m$^2$) and gelatin (0.4 g/m$^2$).

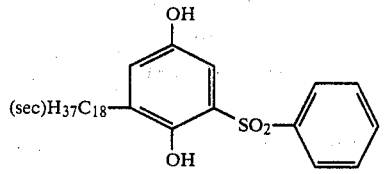

(II)

(7) A layer containing 0.21 g/m$^2$ of a magenta dye releasing redox compound of formula III, 0.11 g/m$^2$ of a magenta dye releasing redox compound of formula IV, tricyclohexylphosphate (0.08 g/m$^2$, 2,5-di-t-pentadecylhydroquinone (0.009 g/m$^2$) and gelatin (0.9 g/m$^2$).

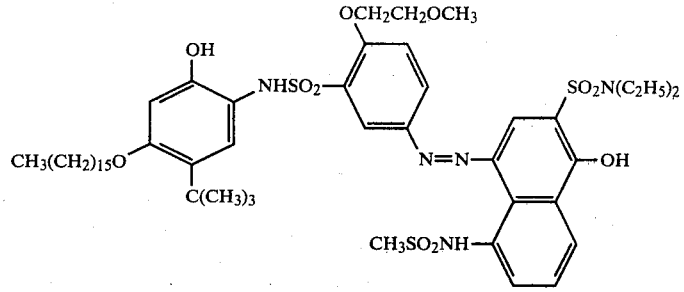

Formula III

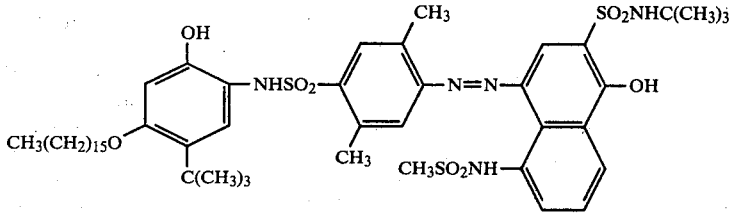

Formula IV (8) A green-sensitive emulsion layer containing Emulsion—1 (silver content 0.82 g/m$^2$) spectrally sensitized with the following green-sensitizing dye, gelatin (0.9 g/m$^2$), the same nucleus forming agent as in layer (5) (0.03 mg/m$^2$) and 2-sulfo-5-n-pentadecylhydroquinone sodium salt (0.08 g/m$^2$).

Green sensitizing dye

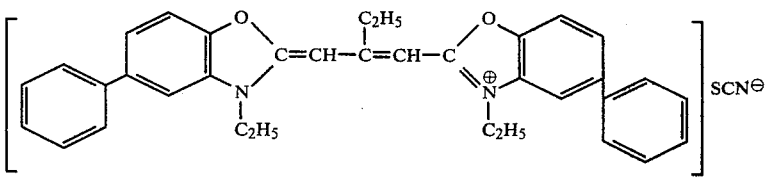

(0.15 mg/m$^2$)

(9) The same layer as in (6).

(10) A layer containing 0.53 g/m$^2$ of a yellow dye releasing redox compound of formula V, tricyclohexylphosphate (0.13 g/m$^2$), 2,5-di-t-pentadecylhydroquinone (0.014 g/m$^2$) and gelatin (0.7 g/m$^2$).

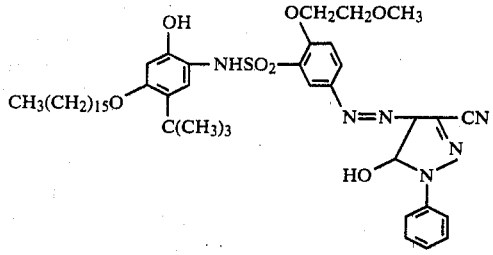

(V)

(11) A blue-sensitive emulsion layer containing Emulsion—1 (silver content 1.09 g/m$^2$), gelatin (1.1 g/m$^2$), the same nucleus forming agent as in layer (5) (0.04 mg/m$^2$) and 2-sulfo-5-n-pentadecylhydroquinone sodium salt (0.07 g/m$^2$).

(12) A layer containing gelatin (1.0 g/m$^2$).

Photosensitive Sheet II was produced by the same procedure as in the Photosensitive Sheet I except that two layers were applied as follows with using Emulsions—2 and —3 instead of the Emulsion—1 to form the red-sensitive layer (5), the green-sensitive layer (8) and the blue-sensitive layer (11).

(i) A red-sensitive emulsion layer having a two layer construction which was prepared by applying a layer (5)-A containing the Emulsion—3 (0.33 g/m$^2$ as the silver content) spectrally sensitized by the above described red-sensitizing dye (0.03 mg/m$^2$), gelatin (0.38 g/m$^2$), the same nucleus forming agent as in the layer (5) (0.013 mg/m$^2$) and 2-sulfo-5-n-pentadecylhydroquinone sodium salt (0.04 g/m$^2$) on the layer (4) and applying a layer (5)-B containing the Emulsion—2 (0.7 g/m$^2$ as the silver content) spectrally sensitized by the same red-sensitizing dye as in the layer (5)-A (0.07 mg/m$^2$), gelatin (0.82 g/m$^2$), the same nucleus forming agent as in the layer (5)-A (0.027 mg/m$^2$) and 2-sulfo-5-n pentadecylhydroquinone sodium salt (0.09 g/m$^2$) on the layer (5)-A, instead of applying the layer (5) on the layer (4).

(ii) A green-sensitive emulsion layer having a two layer construction which was prepared by applying a layer (8)-A containing the Emulsion—3 (0.33 g/m$^2$ as the silver content) spectrally sensitized by the above described green-sensitizing dye (0.06 mg/m$^2$), gelatin (0.36 g/m$^2$), the same nucleus forming agent as in the layer (8) (0.012 mg/m$^2$) and 2-sulfo-5-n-pentadecylhydroquinone sodium salt (0.032 g/m$^2$) on the layer (7) and applying a layer (8)-B containing the Emulsion—2 (0.49 g/m$^2$ as the silver content) spectrally sensitized by the above described green-sensitizing dye (0.09 mg/m$^2$), gelatin (0.54 g/m$^2$), the same nucleus forming agent as in the layer (8) (0.18 mg/m$^2$) and 2-sulfo-5-n-pentadecylhydroquinone sodium salt (0.048 g/m$^2$) on the layer (8)-A, instead of applying the layer (8) on the layer (7).

(iii) A blue-sensitive emulsion layer having a two layer construction which was prepared by applying a layer (11)-A containing Emulsion—3 (0.35 g/m$^2$ as the silver content), gelatin (0.34 g/m$^2$), the same nucleus forming agent as in the layer (11) (0.013 mg/m$^2$) and 2-sulfo-5-n-pentadecylhydroquinone sodium salt (0.022 g/m$^2$) on the layer (10) and applying a layer (11)-B containing the Emulsion—2 (0.74 g/m$^2$ as the silver content), gelatin (0.75 g/m$^2$), the same nucleus forming agent as in the layer (11) (0.027 mg/m$^2$) and 2-sulfo-5-n-pentadecylhydroquinone sodium salt (0.048 g/m$^2$) on the layer (11)-A, instead of applying the layer (11) on the layer (10).

Preparation of Emulsion—2:

To a core emulsion prepared by the same procedure as in the emulsion—1, 1.0 mg of sodium thiosulfate/mol of silver and 1.0 mg of potassium chloroaurate (III)/mol of silver were added, and the emulsion was chemically aged at 60° C. for 45 minutes. To the chemically aged core emulsion, equimolar amounts of an aqueous solution of silver nitrate and an aqueous solution of potassium bromide were added at 60° C. by a control double jet process for 40 minutes to produce a core-shell type direct reversal photographic emulsion having a particle size of 1.32$\mu$. After formation of the shell, 0.5 mg of sodium thiosulfate/mol of silver and 0.04 mg of potassium chloroaurate (III)/mol of silver were added to carry out chemical ageing.

Preparation of Emulsion—3:

To 1 liter of an aqueous solution containing 10 g of gelatin, equimolar amounts of an aqueous solution of silver nitrate and an aqueous solution of potassium bromide were added at 50° C. by a control double jet process for 20 minutes to obtain octahedral silver bromide particles having a particle size of 0.9$\mu$. To the resulting core emulsion, 1.5 mg of sodium thiosulfate/mol of silver and 1.5 mg of potassium chloroaurate (III)/mol of silver were added, and the emulsion was chemically aged at 60° C. for 45 minutes. To the chemically aged core emulsion, equimolar amounts of an aqueous solution of silver nitrate and an aqueous solution of potassium bromide were added at 60° C. by a control double jet process for 40 minutes to produce a core-shell type direct reversal photographic emulsion having a particle size of 1.0$\mu$. After formation of the shell, 1.5 mg of sodium thiosulfate/mol of silver was added to carry out chemical ageing.

To a transparent polyethylene terephthalate support, the following layers (1') to (3') were applied in turn to produce a cover sheet.

(1') A layer containing a 80:20 (ratio by weight) copolymer of acrylic acid and butyl acrylate (22 g/m$^2$) and 1,4-bis-(2,3-epoxypropoxy)butane (0.44 g/m$^2$).

(2') A layer containing acetylcellulose (which forms 39.4 g of acetyl group by hydrolyzing 100 g of acetylcellulose) (3.8 g/m$^2$), a 60:40 (ratio by weight) copolymer of styrene and maleic anhydride (molecular weight: about 50,000)(0.2 g/m$^2$and 5-($\beta$-cyanoethylthio)-1-phenyltetrazole (0.115 g/m$^2$).

(3') A layer containing a 85:12:3 (ratio by weight) copolymer latex of vinylidene chloride, methyl acrylate and acrylic acid (2.5 g/m$^2$) and a polymethylmethacrylate latex (particle size: 1–3 $\mu$m) (0.05 g/m$^2$).

A processing solution having the following composition was prepared.

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethylcellulose Na salt | 58 g |
| Potassium hydroxide (28% aqueous solution) | 200 cc |
| Benzyl alcohol | 1.5 cc |
| Carbon black | 150 g |
| Water | 685 cc |

After the Photosensitive Sheets I and II were exposed to a light wedge for 1/100 seconds, the processing solution was spread thereon at 15° C., 25° C. or 35° C. by means of a pressing member making the layer of processing solution 80 microns thick to obtain a transfer color image. Results (i.e., gradation values) are shown in Table 1.

TABLE 1

| Photosensitive Sheet | | Processing at 15° C. | Processing at 25° C. | Processing at 35° C. | Note |
|---|---|---|---|---|---|
| Photosensitive Sheet I | Blue | 1.55 | 1.75 | 1.80 | Comparison |
| | Green | 1.50 | 1.70 | 1.80 | |
| | Red | 1.55 | 1.70 | 1.80 | |
| Photosensitive Sheet II | Blue | 1.65 | 1.70 | 1.75 | This invention |
| | Green | 1.65 | 1.70 | 1.70 | |
| | Red | 1.65 | 1.65 | 1.65 | |

It is understood from this example that, in the Photosensitive Sheet II wherein the blue-sensitive layer, the green-sensitive layer and the red-sensitive layer have two layers composed of hard tone emulsions, namely, Emulsion—2 and Emulsion—3, the variation of the gradation caused by changing the processing temperature is remarkably reduced as compared with the case of the Photosensitive Sheet I.

It should be noted that the gradation ($\gamma$) of the green-sensitive layer prepared by applying only the Emulsion—2 or the Emulsion—3 was 2.0 and 2.1 (exposure for 1/100 seconds, processing at 25° C.), respectively; this indicates a hard tone. Further, the difference of sensitivity between both layers was 0.3 as log E unit. The gradation ($\gamma$) of the green-sensitive layer prepared by applying only the Emulsion—1 was 1.7 (exposure for 1/100 seconds, processing at 25° C.), which indicates a soft tone.

While the invention has been described in detail and with reference to specific embodiments thereof, it will be apparent to one skilled in the art that various changes and modifications can be made therein without departing from the spirit and scope thereof.

What is claimed is:

1. A photographic sensitive material for a color-diffusion transfer process comprising:

a support;

a red-sensitive emulsion layer on said support;

a green-sensitive emulsion layer on said support; and a blue-sensitive emulsion layer on said support, wherein one of said layers is comprised of a plurality of additional layers including a plurality of direct reversal photographic emulsion layers having higher and lower sensitivity which were not previously fogged, and further wherein said direct reversal photographic emulsion layer having lower sensitivity has a gradation of 1.8 or more.

2. A photographic sensitive material as claimed in claim 1 having higher and lower sensitivity differ in sensitivity by about 0.2 or more as a unit of log E.

3. A photographic sensitive material as claimed in any of claims 1 or 2 wherein said emulsions are comprised of silver halide emulsion comprising a hydrophilic colloid dispersion of silver chloride, silver bromide, silver chlorobromide, silver chloroiodobromide or mixtures thereof.

4. A photographic sensitive material as claimed in claim 3 wherein said silver halide emulsion has an iodine content of 10% by mole or less and a chloride content of 30% by mole or less.

* * * * *